US007778391B2

(12) United States Patent
Fuerst et al.

(10) Patent No.: US 7,778,391 B2
(45) Date of Patent: Aug. 17, 2010

(54) FIELD EMISSION CATHODE AND X-RAY TUBE EMBODYING SAME

(75) Inventors: Jens Fuerst, Herzogenaurach (DE); Stefan Popescu, Erlangen (DE); Georg Wittmann, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/478,052

(22) Filed: Jun. 4, 2009

(65) Prior Publication Data

US 2009/0304157 A1 Dec. 10, 2009

(30) Foreign Application Priority Data

Jun. 4, 2008 (DE) ..... 10 2008 026 634

(51) Int. Cl.
*H01J 35/00* (2006.01)

(52) U.S. Cl. ..... 378/122; 378/121; 378/135; 378/136

(58) Field of Classification Search ..... 378/119, 378/121, 122, 125, 134–136; 313/447
See application file for complete search history.

(56) References Cited

U.S. PATENT DOCUMENTS

| | | | | |
|---|---|---|---|---|
| 6,259,765 | B1 | 7/2001 | Baptist | 378/136 |
| 6,553,096 | B1 | 4/2003 | Zhou et al. | 378/122 |
| 7,388,944 | B2 | 6/2008 | Hempel et al. | 378/122 |
| 2004/0067602 | A1 | 4/2004 | Jin | 438/22 |
| 2007/0086571 | A1 | 4/2007 | Hempel et al. | 378/121 |
| 2007/0247048 | A1 | 10/2007 | Zhang et al. | 313/311 |

FOREIGN PATENT DOCUMENTS

| | | |
|---|---|---|
| DE | 27 27 907 A1 | 1/1979 |
| JP | 2004335420 | 11/2004 |

OTHER PUBLICATIONS

"Stationary Scanning X-ray Source Based on Carbon Nanotube Field Emitters," Zhang et al Applied Physics Letters, vol. 86 pp. 184104-1—184104-3 (2005).

"Field Emission From Carbon Nanotubes and its Application to Electron Sources," Saito et al, Carbon, vol. 38 (2000) pp. 169-182.

"Field Emission Arrays for medical X-ray Imaging," Schwoebel, Applied Physics Letters, vol. 88, pp. 113902-1—113902-3 (2006).

*Primary Examiner*—Courtney Thomas
(74) *Attorney, Agent, or Firm*—Schiff Hardin LLP

(57) ABSTRACT

A field emission cathode has a field emitter and an extraction grid, and the field emitter and the extraction grid can be moved relative to one another. Such a field emission cathode is highly durable and exhibits a longer lifespan. An x-ray tube has a field emission cathode composed of a field emitter and an extraction grid that can be moved relative to one another. Such an x-ray tube is highly durable and exhibits a longer lifespan.

28 Claims, 2 Drawing Sheets

FIELD EMISSION CATHODE AND X-RAY TUBE EMBODYING SAME

BACKGROUND OF THE INVENTION

1. Field of the Invention

The present invention concerns a field emission cathode as well as an x-ray tube with such a field emission cathode.

2. Description of the Prior Art

In x-ray tubes, thermionic emitters (advantageously made of tungsten, tantalum or rhenium) are conventionally used to generate the electron beam required for the generation of x-ray radiation. The thermionic emitter is heated to approximately 2,000° C., causing electrons to be thermionically emitted, and the emitted electrons accelerated toward an anode by an electrical potential of approximately 120 kV. X-ray radiation usable for imaging is created when the thermionically generated electrons strike the anode. Such a thermionic emitter is described in DE 27 27 907 C2, for example. Such thermionic emission has the disadvantage that switching of the heating current requires several seconds since the heating of the thermionic emitter is slow.

As an alternative to the generation of free electrons by means of thermionic emission, the possibility exists to generate free electrons by field emission. By applying a voltage, electrons are extracted from a material with a high emission density, for example carbon nanotubes (CNT), and heating of this material is not necessary. The current densities that can be achieved with such a field emitter are typically less than 1 $A/cm^2$, but well below the current densities of a thermionic emitter (with which current densities up to 10 $A/cm^2$ can be realized). The possibility to quickly switch such a field emitter (known as a "cold emitter" due to the fact that a heating is unnecessary, or only a slight heating is required) makes this technology very attractive for x-ray tubes. If the current density is increased to a few $A/cm^2$, the lifespan of the field emitter is limited. In order to increase the lifespan it is known to arrange multiple emitter modules in parallel in order to distribute the total load of the field emitter among them, thus reducing the total load for the individual emitter modules, and thereby increasing the lifespan of the field emitter. The manufacture of such emitter modules is complicated and consequently is expensive. Furthermore, each emitter module must be activated individually. Therefore this concept can only be realized with technical difficulty in rotating anode x-ray tubes.

In order to achieve high field strengths of greater than 1 V/μm for the electron emission, either a high voltage is required or the distance to the anode must be very short. An additional possibility is the use of an extraction grid (gate electrode) between the field emitter and the anode, that is at a positive potential relative to the electron emission layer. Given distances between approximately 100 μm and 1 mm, the aforementioned field strengths can be generated with average voltages in the range of a few kV, which can be handled easily. The extraction grid is composed of thin tungsten wires, for example, with a wire diameter of a few 10 s of μms, and typically exhibits a grid spacing of 100 to 200 μm.

An x-ray tube with a field emission cathode that has a field emitter and an extraction grid is known from the product brochure "Carbon Nano Tube Based Field Emission X-Ray Tubes", for example. This product information is available at www.xintek.com/products/xray/index.

A rotating anode x-ray tube and a rotary piston x-ray tube that has cold emitters as the electron source are described in DE 10 2005 049 601 A1 and in the corresponding United States Application Publication No. 2007/0086571.

Field emission cathodes with an electron emission made of carbon nanotubes (CNT) are known from U.S. Pat. No. 6,553,096. An extraction grid that is at a positive potential relative to the electron emission is arranged between the field emitter and the anode.

A field emitter with a rod-shaped nanostructure ("nanorods") is disclosed in United States Application Publication No. 2007/0247048.

SUMMARY OF THE INVENTION

An object of the present invention to provide a field emission cathode that is highly durable and has a long service life.

Furthermore, it is an object of the present invention to provide an x-ray tube with a field emission cathode that is highly durable and has a long service life.

The field emission cathode according to the invention has a field emitter and an extraction grid, and the field emitter and the extraction grid are moveable relative to one another (i.e., at least one is moveable relative to the other).

In the field emission cathode according to the invention, the field emitter and the extraction grid are moveable relative to one another, so only the region of the field emitter over which the extraction grid is presently located emits electrons. In the field emission cathode according to the invention, the current density can be markedly increased without reducing the lifespan due to the higher load. If the available increase of the current density is not used, the field emission cathode according to the invention then exhibits a distinctly longer lifespan. The emission current in the field emission cathode according to the invention can be adjusted in a known manner through the grid voltage. In addition to a quick activation, high electron currents can be achieved.

The field emission cathode according to the invention is suitable for stationary anode x-ray tubes, rotary anode x-ray tubes, rotary piston x-ray tubes and stationary anode annular tubes.

In the solution according to the invention, a division of the field emitter into individual emitter modules that are individually controlled, or a structuring of the electron emission layer, is not necessary. The loading of the electron emission layer is already significantly reduced due to relative movement between the field emitter and the extraction grid since an extraction of electrons from the electron emission layer ensues only in the region of the electron emission layer over which the extraction grid is currently located. The regions in which the extraction grid is presently not located emit no electrons. The regions of the field emitter thus are not continuously exposed to the radiant heat originating from a hot focal spot on the anode. The thermal load is therefore correspondingly small.

In the field emission cathode according to the invention, the relative movement of field emitter and extraction grid can be achieved according to advantageous embodiments by

- the field emitter being stationary and the extraction grid can be moved relative to the stationary field emitter, or
- the extraction grid being stationary and the field emitter can be moved relative to the stationary extraction grid, or
- both the field emitter and the extraction grid can be moved.

In a preferred embodiment of the field emission cathode according to the invention, the field emitter has multiple emitter modules arranged in parallel. These emitter modules can be fashioned identically or can respectively exhibit different designs and/or be composed of different materials, corresponding to specific technical requirements. Furthermore, the emitter modules can be controlled together or (for special application cases) individually, so a temporal and/or spatial differentiation of the current flow can be realized.

In a preferred embodiment of the field emission cathode according to the invention, the field emitter is fashioned as a ring and, for example, is arranged on an electrically conductive disc. Due to its rotational symmetry, this embodiment is particularly well suited for rotary anode x-ray tubes and rotary piston x-ray tubes.

In principle, all materials that enable a field emission of electrons are suitable for the field emitter of the field emission cathode according to the invention.

The field emitter advantageously consists of a carbon-based nanomaterial, in particular carbon nanotubes (CNT).

According to one alternative, the field emitter consists of a synthetic graphite, for example graphene, graphenoid or HOPG (Highly Oriented/Ordered Pyrolytic Graphite). Graphene has a field emission comparable to CNT.

According to a further alternative, the field emitter is fashioned as a metal tip emitter, advantageously with etched metal tips made of tungsten, for example.

An embodiment in which the field emitter is executed as a Spindt emitter can also be advantageous for specific application fields.

The x-ray tube according to the invention has a field emitter and an extraction grid that are moved relative to one another, and only the region of the field emitter over which the extraction grid is currently located emits electrons. In the x-ray tube according to the invention, the current density can clearly be increased without reducing the lifespan of the field emitter due to this higher load. If a possible increase of the current density is foregone, the field emission cathode of the x-ray tube according to the invention then exhibits a distinctly longer lifespan. In the field emission cathode of the x-ray tube according to the invention, the emission current can be adjusted in a known manner through the grid voltage. High electron currents can therefore be achieved in addition to a fast control.

The x-ray tube according to the invention can be a stationary anode x-ray tube, a rotary anode x-ray tube, a rotary piston x-ray tube or a stationary anode annular tube.

In the x-ray tube according to the invention, neither a division of the field emitter into individual emitter modules that are respectively to be controlled individually, nor a structuring of the electron emission layer, is necessary. The loading of the electron emission layer is already significantly reduced by the relative movement between the field emitter and the extraction grid since an extraction of electrons from the electron emission layer ensues only in the region of the electron emission layer over which the extraction grid is presently located. The regions in which the extraction grid is not presently located emit no electrons and therefore cool off.

In the x-ray tube, the relative movement of field emitter and extraction grid can be achieved according to advantageous embodiments by

- the field emitter being stationary and the extraction grid can be moved relative to said field emitter or
- the extraction grid is arranged stationary and the field emitter can be moved relative to said extraction grid or
- both the field emitter and the extraction grid can be moved.

In a preferred embodiment of the x-ray tube according to the invention (for example stationary anode annular tube), the field emitter is composed of multiple emitter modules arranged in parallel. These emitter modules can be fashioned identically or can exhibit respectively different designs and/or be composed of different materials, corresponding to specific technical requirements. Furthermore, the emitter modules can be controlled together or (for special application cases) individually, so a temporal and/or spatial differentiation of the current flow can be realized.

In a preferred embodiment of the field emission cathode according to the invention, the field emitter is fashioned as a ring and is arranged on an electrically conductive disc. Due to its rotational symmetry, this embodiment can be realized particularly well in rotary anode x-ray tubes.

In principle, all materials that enable a field emission of electrons are suitable for the field emitter of the x-ray tube according to the invention. For example, carbon-based nanomaterials are suitable, in particular carbon nanotubes (CNT) or synthetic graphite, for example graphene, graphenoid or HOPG (Highly Oriented/Ordered Pyrolytic Graphite).

According to a further alternative, the field emitter of the x-ray tube according to the invention is fashioned as a metal tip emitter, advantageously with etched metal tips made of tungsten, for example.

An embodiment of the x-ray tube according to the invention in which the field emitter is executed as a Spindt emitter can also be advantageous for specific application fields.

DESCRIPTION OF THE PREFERRED EMBODIMENTS

Figure 1:
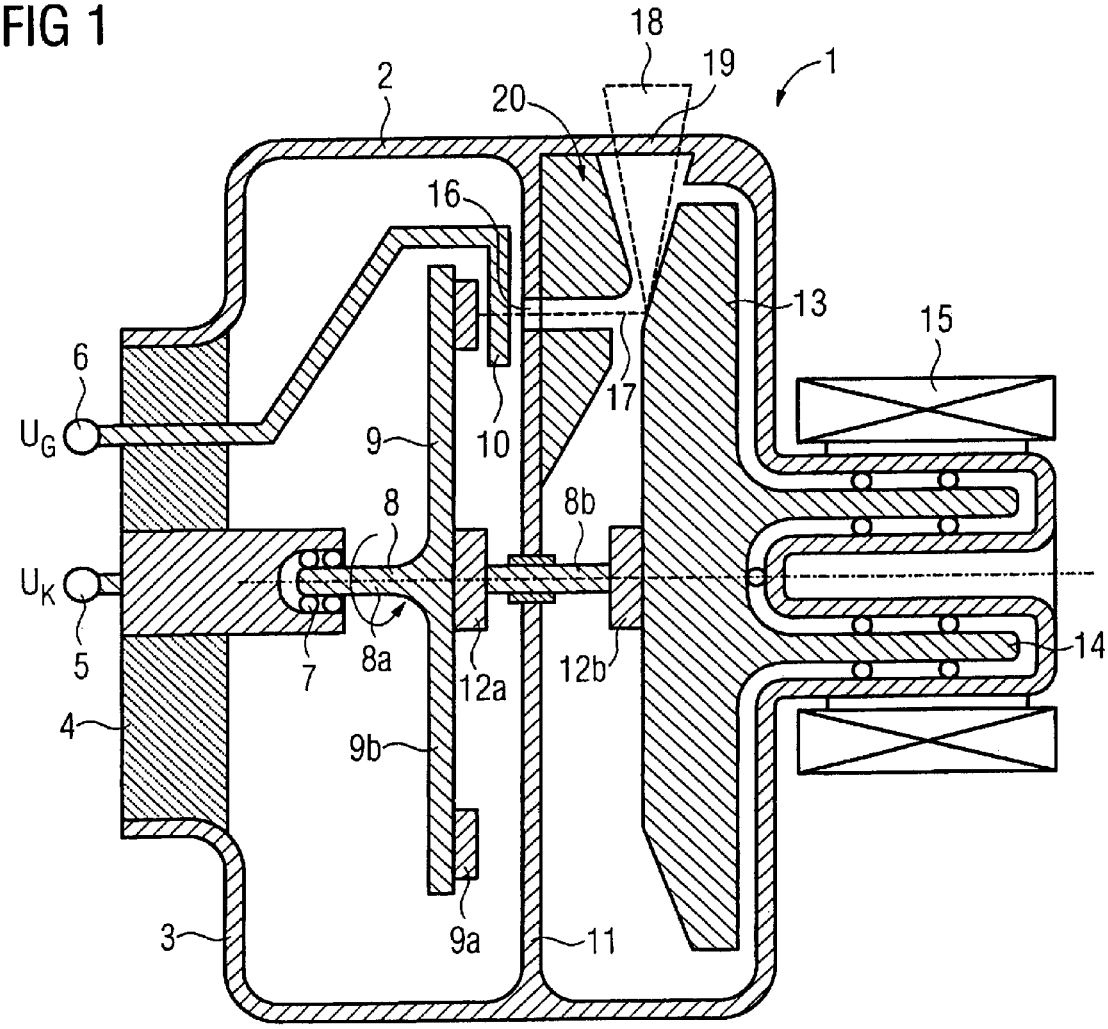
FIG. 1 schematically illustrates a first embodiment of an x-ray tube according to the invention, in longitudinal section.

An x-ray tube 1 that is executed as a rotary anode x-ray tube is shown in FIG. 1.

The x-ray tube 1 has a stationary vacuum housing 2 with a high-voltage side 3 that possesses an insulating body 4 made of ceramic.

The x-ray tube 1 is mounted in a known manner in a radiator housing (now shown). A coolant liquid is located between the vacuum housing 2 and the radiator housing.

A high voltage connection (terminal) 5 and a high voltage connection 6 are arranged in the insulating body 4. The high voltage connection 5 is at a cathode potential $U_K$, for example −120 kV, and is connected to an electrically conductive bearing 7 in which a shaft 8 is mounted such that it can rotate. A field emitter 9 is arranged on the shaft 8 such that it is rotationally fixed.

The high voltage connection 6 is connected to a stationary extraction grid 10 at a grid potential $U_G$ that increases the negative cathode potential $U_K$ by an extraction potential $U_E$ of, for example, +2 kV. In the shown exemplary embodiment, the grid potential $U_G$ is thus −118 kV. The grid potential $U_G$ is thus more positive by 2 kV relative to the cathode potential $U_K$.

The field emission cathode of the x-ray tube 1 thus is formed by the field emitter 9, the extraction grid 10 and the associated high voltage connections 5 and 6.

The field emitter 9 has a field emitter ring **9*a* that, in the shown exemplary embodiment, consists of carbon nanotubes. The field emitter ring 9*a* is arranged on an electrically conductive field emitter substrate disc 9*b* that is seated in a rotationally fixed manner on the shaft 8. The shaft 8 is furthermore mounted such that it can rotate inside a protective wall 11 and is connected with a rotary anode 13 at ground potential $U_M$ in a mechanically rigid and electrically insulated manner via two insulating bodies 12*a* and 12*b***.

The shaft 8 thus has a shaft segment 8*a* that directs a voltage (cathode potential $U_K$) to the field emitter substrate disc 9*b* and an insulating shaft segment 8*b* following the shaft segment 8*a*.

Voltage flashovers (arcings) are thus reliably prevented by dividing the shaft 8 into a voltage-conducting shaft segment 8*a* and an insulating (thus voltage-free) shaft segment 8*b*.

The anode 13 is mounted such that it can rotate with its free end in an axially cooled ball bearing 14 (rotary anode) and is driven by a motor 15 (electromotor) upon operation of the x-ray tube 1. Due to the rotationally fixed connection via the insulating bodies 12*a* and 12*b* the field emitter substrate disc 9*b* is also driven by the motor 15 (common drive for field emitter 9 and rotary anode 13).

In the x-ray tube 1 (rotary anode x-ray tube) shown in the drawing, anode 13 and field emitter 9 thus rotate in the same direction and with the same speed.

The protective wall 11 has an opening 16 for an electron beam 17 generated by the field emitter ring 9*a*.

During rotation, upon reaching the stationary extraction grid 10 the field emitter ring 9*a* is locally activated and thus emits electrons that exit the protective wall 11 as an electron beam 17 through the opening 16 and strike the anode 13. When the electron beam 17 strikes the anode 13, x-ray radiation 18 is generated in a known manner that exits through an x-ray exit window 19 arranged in the vacuum housing 2.

The heating of the anode 13 that is creating upon the electron beam 17 striking the focal spot path leads to thermionic radiation of the anode 13 and to the exit of cations (positive ions) from the focal spot path. The field emitter 9 must be protected from the thermionic radiation and from the cations exiting from the anode 13. The protective wall 11 fulfills this task.

In the region of the opening 16, the protective wall 11 has a back-scatter collector 20 on its side facing the anode 13, for catching scattered back electrons. The loading of the anode 13 is significantly reduced by the collection of the back-scatter electrons.

Due to mechanically-caused oscillations in the rotation movement of the field emitter 9, the electron emission varies corresponding to the slightly varying field intensity between the extraction grid 10 and the field emitter 9. This is compensated in the exemplary embodiment shown in FIG. 1 by a dynamic adaptation of the grid potential $U_G$.

The x-ray tube shown in FIG. 1 enables a fast modulation of the electron current and is therefore particularly suited for what are known as "dual energy" applications and dose modulations, in particular for clocked (synchronized) x-ray generation.

Furthermore, the x-ray tube 1 according to FIG. 1 exhibits a reduced extrafocal radiation since the x-ray radiation 18 is collimated near the focal spot.

Figure 2:
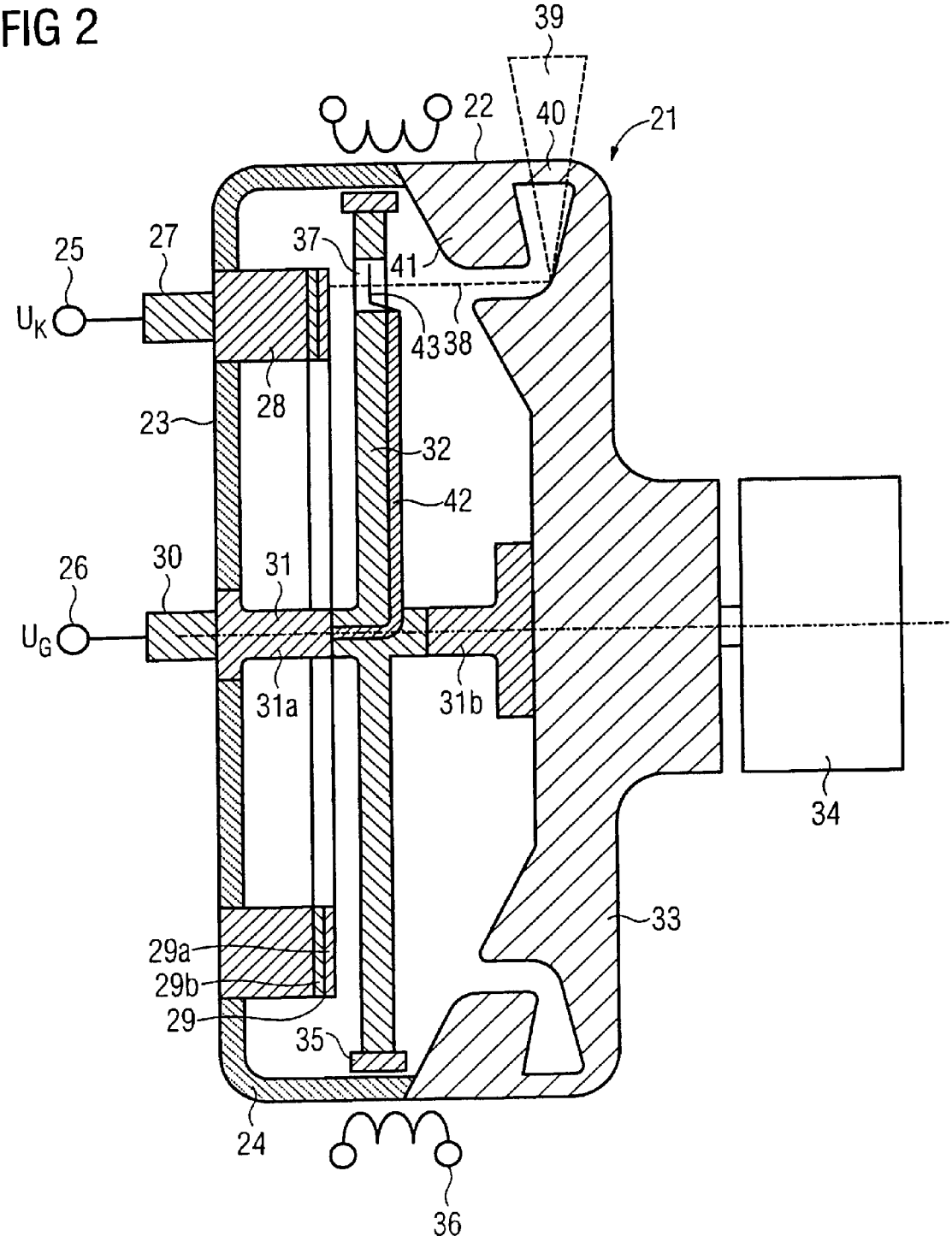
FIG. 2 schematically illustrates a second embodiment of an x-ray tube according to the invention, in longitudinal section.

The x-ray tube 21 shown in FIG. 2 is a rotary piston x-ray tube.

The x-ray tube 21 has a rotating vacuum housing 22 with a high voltage side 23 that is executed as an insulated housing part 24 made of ceramic.

The x-ray tube 21 furthermore has a high voltage connection [terminal] 25 and a high voltage connection 26.

The high voltage connection 25 lies at a cathode potential $U_K$ of −120 kV, for example, and is directed via a brush 27 to a slip ring 28 that is arranged in the insulated housing part 24. A field emitter 29 is connected with the slip ring 28 so as to be mechanically rigid and electrically conductive. The field emitter 29 has a field emitter ring 29*a* that, in the shown exemplary embodiment, consists of carbon nanotubes. The field emitter ring 29*a* is arranged on an electrically conductive field emitter substrate ring 29*b* that is connected with the slip ring 28 in an electrically conductive manner.

The high voltage connection path 26 proceeds through a brush 30 to a shaft 31 and from this via an electrical conductor 42 to a stationary extraction grid 43 that is arranged on a substrate disc 32. The substrate disc 32 of the extraction grid 43 simultaneously forms an insulating protective wall. The high voltage connection 26 is at a grid potential $U_G$ that increases the negative cathode potential $U_K$ by an extraction potential $U_E$ of +2V. In the shown exemplary embodiment, the grid potential $U_G$ thus amounts to −118 kV. The grid potential $U_G$ is thus more positive by 2 kV relative to the cathode potential $U_K$.

The field emission cathode of the x-ray tube 21 thus is formed by the field emitter 29, the extraction grid 43 as well as the associated high voltage connections 25 and 26.

The shaft 31 thus has a shaft segment 31*a* directing a voltage (cathode potential $U_K$) up to the extraction grid 43. The extraction grid 32 is arranged on the shaft 31 such that it can move in rotation but is axially rigid, wherein the stationary position of the extraction grid 43 is achieved via an external electromagnetic field.

The other end of the shaft 31 is executed as an insulating shaft segment 31*b*. The insulating shaft segment 31*b* is connected in a rotationally fixed manner with an anode 33 lying at ground potential $U_M$.

Voltage flashovers (arcings) are reliably prevented via the measure to divide the shaft 31 into a voltage-conducting shaft segment 31*a* and an insulating (thus voltage-free) shaft segment 31*b*.

In the x-ray tube 21 shown in FIG. 2, the insulating housing part 24 and the outside of the anode 33 thus form the rotating vacuum housing 22, and the field emitter 29 is attached to the inside of the insulating housing part 24 via the slip ring 28. The vacuum housing 22 and the field emitter 29 thus rotate in the same direction and with the same speed.

The shaft 31, which bears all parts of the vacuum housing 22 (insulating housing part 24, anode 33) is driven by a motor 34 (electromotor) during operation of the x-ray tube 21.

The x-ray tube 21 is borne in a known manner in a radiator housing (not shown). A coolant liquid is located between the vacuum housing 22 and the radiator housing. Since the outside of the anode 33 forms a part of the vacuum housing 22, the anode 33 is a directly cooled anode.

The extraction grid 43 is arranged on the shaft 31 such that it can move in rotation and is axially rigid, and the stationary position of the extraction grid 43 is achieved by an external electromagnetic field that acts on a permanent magnet ring 35 that is arranged on the external circumferential side of the extraction grid 43. The external electromagnetic field is generated on a coil arrangement 36 that is arranged outside of the vacuum housing 22. The extraction grid 43 thus does not execute any rotation movement (in contrast to the vacuum housing 22).

The extraction grid 43, which is electromagnetically fixed during the operation of the x-ray tube, possesses an opening 37 for an electron beam 38 generated by the field emitter ring 29*a*.

During its rotation, upon reaching the stationary extraction grid 43 the field emitter ring 29*a* is locally activated and hereby emits electrons that exit as an electron beam 38 through the opening 37 of the extraction grid 43 and strike the anode 33. When the electron beam 38 strikes the anode 33, x-ray radiation 39 is generated in a known manner that exits through an x-ray exit window 40 arranged in the vacuum housing 22.

In the region of the opening 37, the vacuum housing 22 has a back-scatter collector 41 on its inside for catching scattered back electrons. The loading of the anode 43 is significantly reduced by the collection of the back-scatter electrons.

Furthermore, the x-ray tube 21 according to FIG. 2 exhibits reduced extrafocal radiation since the x-ray radiation 39 is collimated near the focal spot by a corresponding geometric design of the inside of the vacuum housing 22.

The heating of the anode 33 generated when the electron beam 38 strikes the focal spot path leads to a thermionic radiation of the anode 33 as well as to the exit of cations (positive ions) from the focal spot path. The field emitter 29*a* must be protected from the thermionic radiation and from the cations exiting from the anode 33. In the x-ray tube 21 according to FIG. 2, this is ensured by the extraction grid 43.

The invention is not limited to the exemplary embodiments shown in FIGS. 1 and 2, which respectively show x-ray tubes 1 and 21 with rotating field emitters 9 and 29 and stationary extraction grids 10 and 43. Rather, additional advantageous embodiments of the field emission cathode according to the invention or of x-ray tubes according to the invention are possible within the scope of the invention.

For example, the field emitter can be arranged stationary and the extraction grid can be movable relative to the field emitter. Furthermore, within the scope of the invention it is also possible for both the field emitter and the extraction grid to be movable.

Moreover, the field emitters 9 and 29 do not necessarily have to consist of carbon nanotubes (CNT). In principle, all materials that enable a field emission of electrons are suitable for the field emitter of the field emission cathode according to the invention.

Although modifications and changes may be suggested by those skilled in the art, it is the intention of the inventors to embody within the patent warranted hereon all changes and modifications as reasonably and properly come within the scope of their contribution to the art.

We claim as our invention:

1. A field emission cathode comprising:

a field emitter;

an extraction grid that generates an extraction field that causes electrons to be extracted from said field emitter; and a mounting structure in which said field emitter and said extraction grid are mounted that produces relative movement between said field emitter and said extraction grid.

2. A field emission cathode as claimed in claim 1 wherein said mounting structure holds said field emitter stationary and causes said extraction grid to move relative to said field emitter.

3. A field emission cathode as claimed in claim 1 wherein said mounting structure holds the extraction grid stationary and produces movement of the field emitter relative to the extraction grid.

4. A field emission cathode as claimed in claim 1 wherein said mounting structure causes both said field emitter and said extraction grid to move relative to each other.

5. A field emission cathode as claimed in claim 1 wherein said field emitter comprises multiple emitter modules arranged in parallel with each other.

6. A field emission cathode as claimed in claim 1 wherein said field emitter is formed as a ring.

7. A field emission cathode as claimed in claim 6 comprising an electrically conducted disk on which said ring formed by said field emitter is disposed.

8. A field emission cathode as claimed in claim 1 wherein said field emitter consists of carbon-based nanomaterial.

9. A field emission cathode as claimed in claim 1 wherein said field emitter consists of carbon nanotubes.

10. A field emission cathode as claimed in claim 1 wherein said field emitter consists of a synthetic graphite.

11. A field emission cathode as claimed in claim 9 wherein said synthetic graphite is selected from the group consisting of a synthetic grapheme or a synthetic graphenoid.

12. A field emission cathode as claimed in claim 1 wherein said field emitter is configured as a metal tip emitter.

13. A field emission cathode as claimed in claim 1 wherein said field emitter is configured as a Spindt emitter.

14. A field emission cathode as claimed in claim 1 wherein said mounting structure produces relative rotational movement between said field emitter and said extraction grip.

15. An x-ray tube comprising:

a field emitter;

an extraction grid that generates an extraction field that causes electrons to be extracted from said field emitter;

a mounting structure in which said field emitter and said extraction grid are mounted that produces relative movement between said field emitter and said extraction grid; and an anode that is struck by said electrons extracted from said field emission cathode, said electrons, upon striking said anode, causing x-rays to be emitted form said anode.

16. An x-ray tube as claimed in claim 15 wherein said mounting structure holds said field emitter stationary and causes said extraction grid to move relative to said field emitter.

17. An x-ray tube as claimed in claim 15 wherein said mounting structure holds the extraction grid stationary and produces movement of the field emitter relative to the extraction grid.

18. An x-ray tube as claimed in claim 15 wherein said mounting structure causes both said field emitter and said extraction grid to move relative to each other.

19. An x-ray tube as claimed in claim 15 wherein said field emitter comprises multiple emitter modules arranged in parallel with each other.

20. An x-ray tube as claimed in claim 15 wherein said field emitter is formed as a ring.

21. An x-ray tube as claimed in claim 20 comprising an electrically conducted disk on which said ring formed by said field emitter is disposed.

22. An x-ray tube as claimed in claim 15 wherein said field emitter consists of carbon-based nanomaterial.

23. An x-ray tube as claimed in claim 15 wherein said field emitter consists of carbon nanotubes.

24. An x-ray tube as claimed in claim 15 wherein said field emitter consists of a synthetic graphite.

25. An x-ray tube as claimed in claim 24 wherein said synthetic graphite is selected from the group consisting of a synthetic grapheme or a synthetic graphenoid.

26. An x-ray tube as claimed in claim 15 wherein said field emitter is configured as a metal tip emitter.

27. An x-ray tube as claimed in claim 15 wherein said field emitter is configured as a Spindt emitter.

28. An x-ray tube as claimed in claim 15 wherein said mounting structure produces relative rotational movement between said field emitter and said extraction grip.

* * * * *